United States Patent [19]

Checke

[11] Patent Number: 4,785,932

[45] Date of Patent: Nov. 22, 1988

[54] MEDICINE DISPENSER

[76] Inventor: Amedeo Checke, 4 Cherry St., Middletown, N.Y. 10940

[21] Appl. No.: 61,410

[22] Filed: Jun. 15, 1987

[51] Int. Cl.[4] ..... B65D 83/04

[52] U.S. Cl. ..... 206/232; 206/534; 206/538

[58] Field of Search ..... 206/528, 534, 534.1, 206/534.2, 538, 539, 540, 459, 232

[56] References Cited

U.S. PATENT DOCUMENTS

| | | | |
|---|---|---|---|
| 678,284 | 7/1901 | Schaffer | 206/232 X |
| 1,421,219 | 6/1922 | Harmon | 206/459 X |
| 1,717,060 | 7/1929 | Mottayaw | 206/534 |
| 2,822,082 | 2/1958 | Breckwoldt et al. | 206/232 X |
| 2,895,602 | 7/1959 | Hait | 206/459 X |
| 3,111,220 | 11/1963 | Bostrom | 206/534 X |
| 3,225,913 | 12/1965 | Lee | 206/534 |
| 3,243,037 | 3/1966 | Luertzing | 206/232 |
| 3,911,856 | 10/1975 | Ewing | 206/534 |
| 4,039,080 | 8/1977 | Cappuccilli | 206/534 |
| 4,573,580 | 3/1986 | Messer | 206/534 |
| 4,693,371 | 4/1987 | Malpass | 206/534 |

FOREIGN PATENT DOCUMENTS

| | | | |
|---|---|---|---|
| 3326653 | 2/1985 | Fed. Rep. of Germany | 206/459 |

*Primary Examiner*—Stephen Marcus

*Attorney, Agent, or Firm*—Gifford, Groh, Sheridan, Sprinkle and Dolgorukov

[57] ABSTRACT

A medicine dispenser comprises a plurality of elongate open receptacles. Beneath the receptacles is an open-ended compartment having resilient bias means therein for holding prescriptions and the like. Axially aligned with each receptacle is a simulated clock face and a spinner rotatably mounted in each clock face. A finger on each spinner, when rotated, points to an hour when medicine in a respective receptacle should be taken.

4 Claims, 1 Drawing Sheet

MEDICINE DISPENSER

BACKGROUND OF THE INVENTION

1. Field

The present invention relates generally to devices for containing medicines and, more particularly, to devices that indicate and remind a person of the time when a certain medication in the form of capsules or pills is to be taken.

2. Prior Art

Among the prior art, the following patents are of interest:

U.S. Pat. No. 1,717,060 to M. Mottayaw discloses a device that includes a timepiece and twelve receptacles for holding medication; each receptacle placed opposite an hour indicated on the device.

U.S. Pat. No. 3,111,220 to J. Bostrom discloses a reclosable container having recesses for holding capsule or pill form medication, with a closure for the container.

U.S. Pat. No. 3,911,856 to C. Ewing discloses a medication dispenser with a timer to tell the time of day, and compartments in which capsule or pill-form medication is placed.

French Pat. No. 2,431,4434 to David discloses a pillbox with indicator of the time since the last pill was taken.

SUMMARY OF THE INVENTION

A medicine dispenser comprises a plurality of open receptacles with an open-ended compartment beneath the receptacles. A hinged cover is disposed over the receptacles. Axially aligned with each receptacle is a recess in which is a simulated clock face with numerals thereon and a spinner is pivoted in each clock face. A finger on the spinner, when rotated, points to an hour when the medication in a respective receptacle is to be taken.

An objective of the invention is to provide a medicine dispenser having several receptacles shaped so that medicine therein may easily be removed; the dispenser having an openended compartment beneath the receptacles for storage of prescriptions and the like; and a reminder to tell the person when a medicine is to be taken.

Other objects and advantages of the present invention will become apparent to those skilled in the art when the following description of the best mode contemplated at present for practicing the invention are read in conjunction with the accompanying drawing, wherein like reference numerals refer to like or equivalent parts.

DETAILED DESCRIPTION

Figure 1:
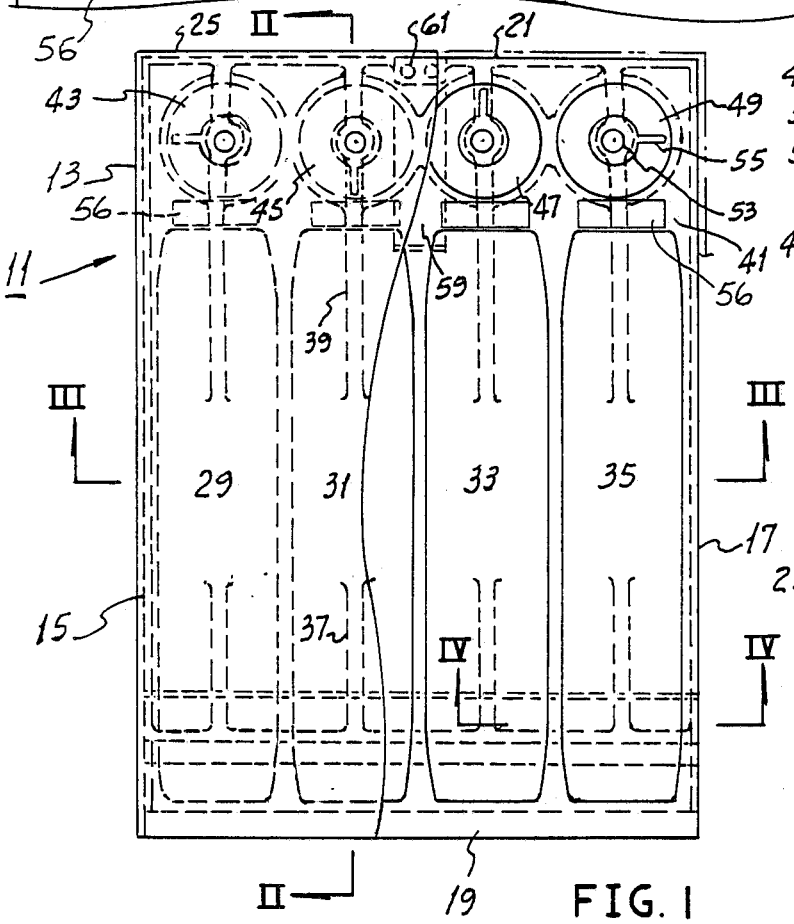
FIG. 1 is a plan view of the dispenser of the invention with the top lid broken away partially to disclose the interior structure.

Referring to FIG. 1, a medicine dispenser 11 in accordance with a preferred embodiment of the invention comprises a rectangular box-like structure 13 having two parallel, spaced-apart long sides 15,17; two parallel, spaced-apart ends 19,21 connected to the ends of the long sides 15,17; and a bottom 23 connected to the sides 15, 17 and to one end 19. A top 25 is hinged, as at 27, to the end 21.

Figure 3:
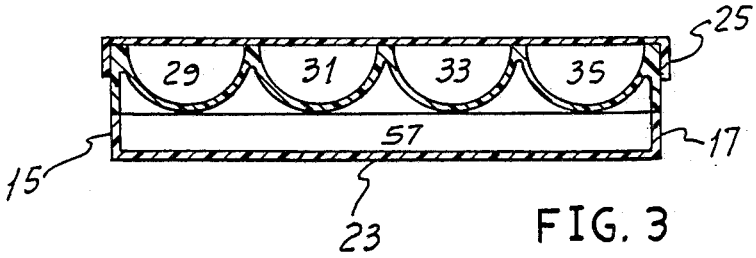
FIG. 3 is a view along line III—III of FIG. 1.
Figure 4:
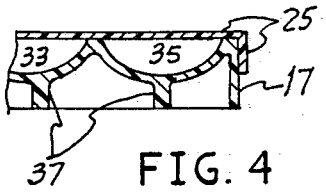
FIG. 4 is a view along line IV—IV of FIG. 1.

Disposed within the dispenser 11 are four elongate, shallow, dish-like compartments 29,31,33,35, each one having a semi-circular cross-sectional shape as shown in FIG. 3. At the ends of each compartment, and disposed beneath each compartment 29–35 are rib members 37,39. Only one set of ribs for only one compartment is shown, however.

Figure 5:
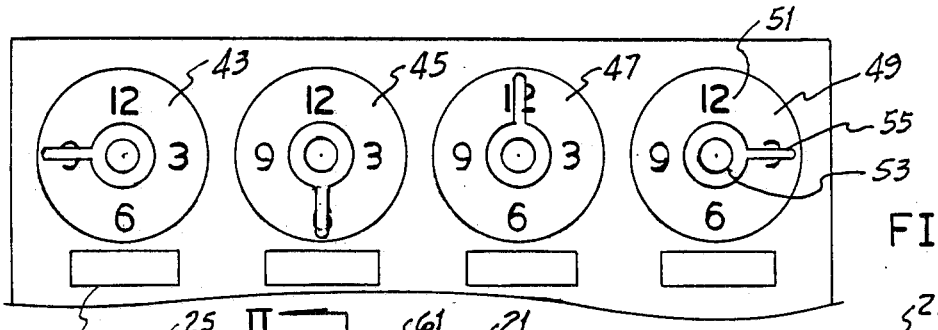
FIG. 5 is a view of a portion of FIG. 1 at an enlarged scale.
Figure 2:
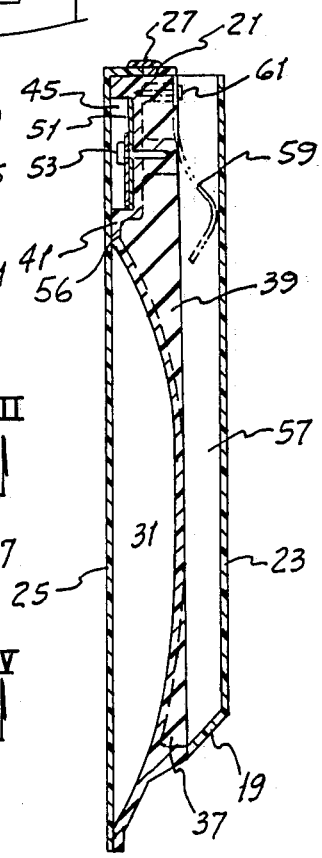
FIG. 2 is a view along line II—II of FIG. 1.

The upper end portion of the dispenser 11, as viewed in FIGS. 1,2,5 comprises a flat planar surface 41 in which there are four circular depressions 43,45,47,49; each depression being axially aligned with a respective medicine compartment 29–35. In each depression is a simulated clock face 51, seen in FIG. 5, showing the hours 3,6,9,12 of a day or night. Centered in each clock face 51 is a spinner 53 having a finger 55 that points to the hour of the day or night.

Associated with each clock face, in the flat planar surface 41, referring to FIG. 5, is a rectangular receptacle 56 in which reminder information relative to a particular medicine in a respective compartment 29–35 may be displayed. Such reminder information may be "Bedtime"; "Noon"; "3 PM"; "After Meals"; and the like reminder information.

As shown in FIG. 2, the end 21 does not connect to the bottom 23 and an open compartment 57 is thereby created beneath the several medication compartments 29–35. A leaf-type spring 59 is mounted to the end 21 near the open end of the compartment 57, which spring 59, contacts the inner surface of the bottom 23. The left-type spring 59 is mounted to the end 21, about where shown in FIGS. 1 and 2, by means of screw fasteners 61.

From the foregoing description of a preferred embodiment of the present invention, those skilled in the art will recognize many features and advantages thereof, among which the following are significant:

That the medication dispenser is simple to construct;

That the medication in each compartment is easy to remove by a patient who may have difficulty closing fingers to grasp a unit of medication; and That the open bottom affords storage for prescriptions and other papers directed to the medication and the taking of such medication.

Although the invention has been described herein with a certain degree of particularity, it is understood that other modifications may be made therein without departing from the scope of the present invention as defined by the following claims.

What is claimed is:

1. A container for medicine comprising a plurality of receptacles, each one having an arcuate longitudinal cross-sectional shape and a semi-circular transverse cross-sectional shape; a simulated clock face with numerals thereon mounted adjacent each said receptacle; a spinner with finger pivotally mounted and axially aligned longitudinally with each receptacle; a cover over said receptacles that is hinged; an open-ended compartment having a bottom aligned longitudinally substantially across and disposed beneath said receptacles; and resilient means mounted in said open-ended compartment contacting said bottom of said open-ended compartment wherein said resilient means comprises a leaf type spring adapted to frictionally engage a document inserted into said open-ended compartment and entrap the document between said spring and said bottom of said open-ended compartment.

2. The container of claim 1 wherein each clock face with spinner is disposed in a depression in said container.

3. The container of claim 1 including a receptacle adjacent each compartment in which information relative to medicine in a respective compartment is displayed.

4. The container of claim 1 including rib structure extending longitudinally beneath each compartment.

* * * * *